US007429144B1

(12) United States Patent
Lai

(10) Patent No.: US 7,429,144 B1
(45) Date of Patent: Sep. 30, 2008

(54) PAVING BRICK ASSEMBLY

(76) Inventor: Huo-Mu Lai, No. 133, Cheng-Hsin Rd., Heng-Shan Tsun, Ta-Ya Hsiang, Taichung Hsien (TW)

( * ) Notice: Subject to any disclaimer, the term of this patent is extended or adjusted under 35 U.S.C. 154(b) by 0 days.

(21) Appl. No.: 11/999,807

(22) Filed: Dec. 7, 2007

(51) Int. Cl.
*E01C 5/00* (2006.01)

(52) U.S. Cl. ..... 404/40; 404/41; 404/34; 52/596; 52/604

(58) Field of Classification Search ..... 52/596, 52/598, 599, 603–607; 404/34, 38, 40, 41; D25/113
See application file for complete search history.

(56) References Cited

U.S. PATENT DOCUMENTS 401,361 A * 4/1889 McReynolds et al. ..... 404/38
478,612 A * 7/1892 Lance ..... 404/38
929,210 A * 7/1909 Grebe ..... 404/38
2,060,746 A * 11/1936 Porter ..... 404/38
4,372,705 A * 2/1983 Atkinson ..... 405/19
4,997,308 A * 3/1991 Welling, Jr. ..... 404/38
6,578,338 B1 * 6/2003 Nanayakkara ..... 52/606
6,705,797 B1 * 3/2004 Wada ..... 404/38

* cited by examiner

*Primary Examiner*—Gary S Hartmann
(74) *Attorney, Agent, or Firm*—Townsend and Townsend and Crew, LLP

(57) ABSTRACT

A paving brick assembly includes: a plurality of polygonal main bricks, each of which has a plurality of first lateral sides and a plurality of second lateral sides that are alternately disposed with the first lateral sides, each of the first lateral sides being formed with a vertical protrusion, each of the second lateral sides being formed with a vertical groove and a horizontal groove; and a plurality of polygonal connecting bricks, each of which has a pair of opposite connecting lateral sides and a pair of opposite coupling lateral sides. Each of the connecting lateral sides is formed with a connecting protrusion. Each of the coupling lateral sides is formed with a coupling groove.

12 Claims, 17 Drawing Sheets

PAVING BRICK ASSEMBLY

BACKGROUND OF THE INVENTION

1. Field of the Invention

The invention relates to a paving brick assembly, more particularly to a paving brick assembly having main bricks and a connecting brick wedging into two adjacent ones of the main bricks in a horizontal direction.

2. Description of the Related Art

As shown in FIG. 1, a conventional paving brick 10 has a generally square shape and is formed with a square central hole 12 for loading soil therein. The brick 10 has a pair of diagonally disposed corner protrusions 13, and a pair of diagonally disposed corner grooves 14 such that one brick 10 can engage another brick 10 through engagement between one of the corner protrusions 13 of said one brick 10 and a corresponding one of the corner grooves 14 of said another brick 10. Although the conventional paving brick 10 facilitates construction of a paving brick assembly, the entire paving brick assembly tends to become uneven after a period of use and is vulnerable to theft or removal by sabotage.

As shown in FIG. 2, another conventional paving brick 20 has a generally hexagonal shape, and has three first lateral sides 21 and three second lateral sides 22 that are alternately disposed with the first lateral sides 21. Each of the first lateral sides 21 is formed with a vertical protrusion 211, and each of the second lateral sides 22 is formed with a vertical groove 221 and a stop wall 222 confining a bottom of the vertical groove 221. In assembly, the stop wall 222 of one brick 20 abuts against the vertical protrusion 211 of another brick 20 when the latter is received in the vertical groove 221. However, the paving brick assembly constructed by the paving bricks 20 has the same drawback of being susceptible to theft or removal by sabotage.

SUMMARY OF THE INVENTION

Therefore, the object of the present invention is to provide a paving brick assembly that can overcome the aforesaid drawbacks associated with the prior art.

Accordingly, a paving brick assembly of the present invention comprises: a plurality of polygonal main bricks, each of which has a plurality of first lateral sides and a plurality of second lateral sides that are alternately disposed with the first lateral sides, each of the first lateral sides being formed with a vertical protrusion extending in a vertical direction, each of the second lateral sides being formed with a vertical groove and a horizontal groove extending in a horizontal direction transverse to the horizontal direction; and a plurality of polygonal connecting bricks, each of which has a pair of opposite connecting lateral sides and a pair of opposite coupling lateral sides. Each of the connecting lateral sides is formed with a connecting protrusion. Each of the coupling lateral sides is formed with a coupling groove. The connecting protrusion of each of the connecting lateral sides of each of the connecting bricks is engageable releasably with the horizontal groove in a selected one of the second lateral sides of a selected one of the main bricks. The coupling groove in each of the coupling lateral sides of each of the connecting bricks is engageable releasably with the vertical protrusion of a selected one of the first lateral sides of a selected one of the main bricks. The vertical protrusion of each of the first lateral sides of each of the main bricks is engageable releasably with the vertical groove in a selected one of the second lateral sides of a selected one of the remainder of the main bricks.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
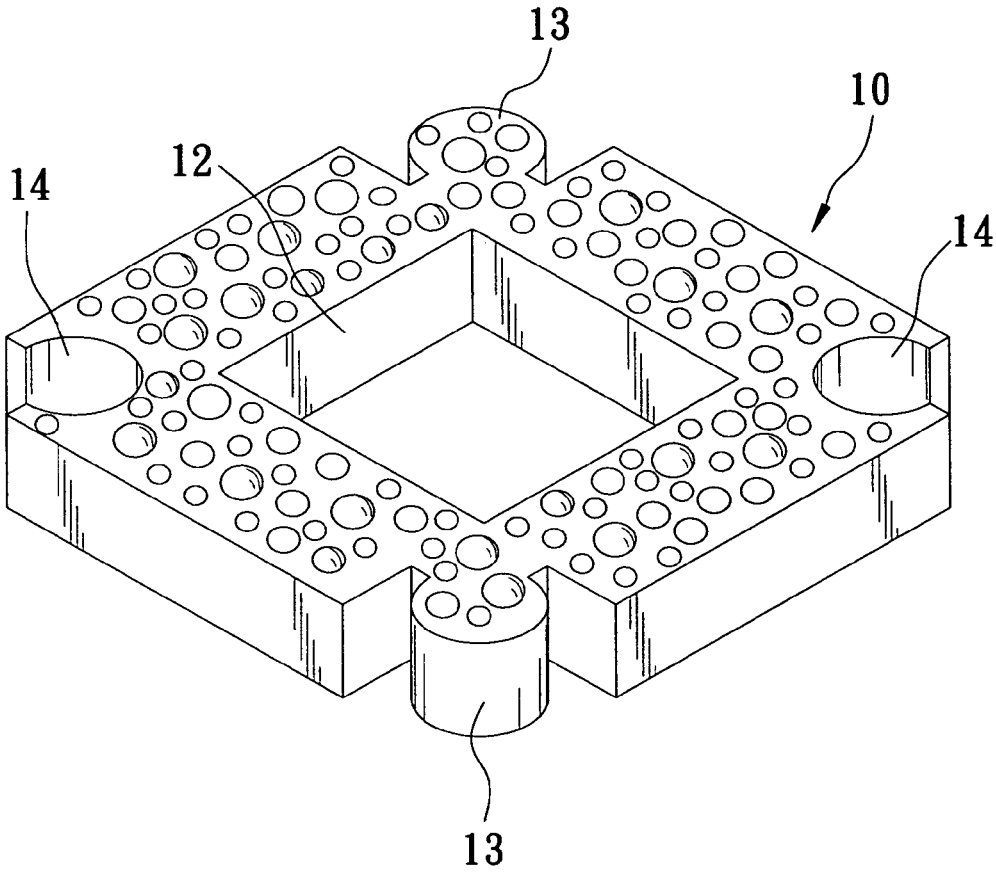
FIG. 1 PRIOR ART
FIG. 1 is a perspective view of a conventional paving brick.
Figure 2:
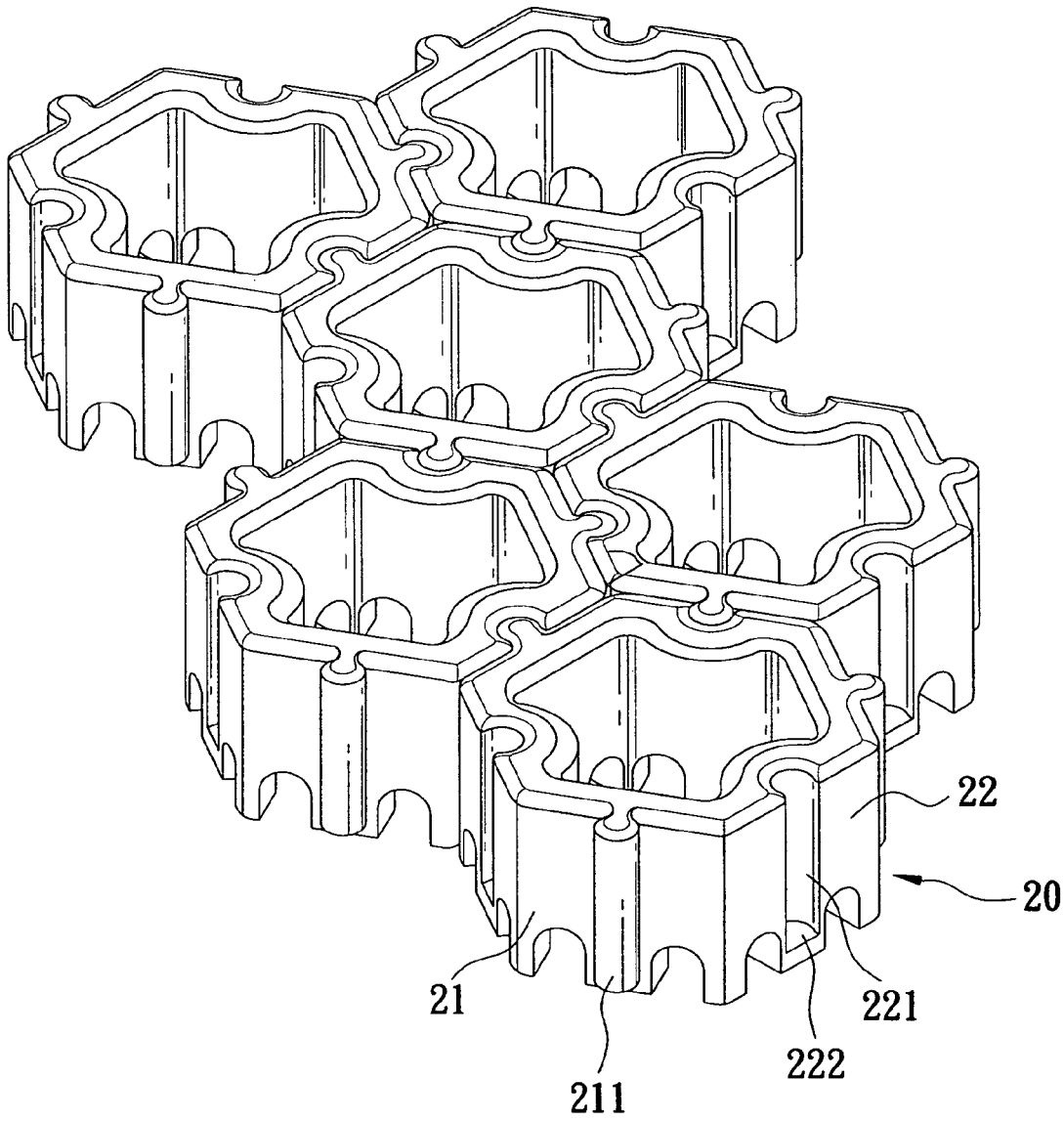
FIG. 2 PRIOR ART
FIG. 2 is an assembled perspective view of a paving brick assembly constructed using another conventional paving brick.
Figure 3:
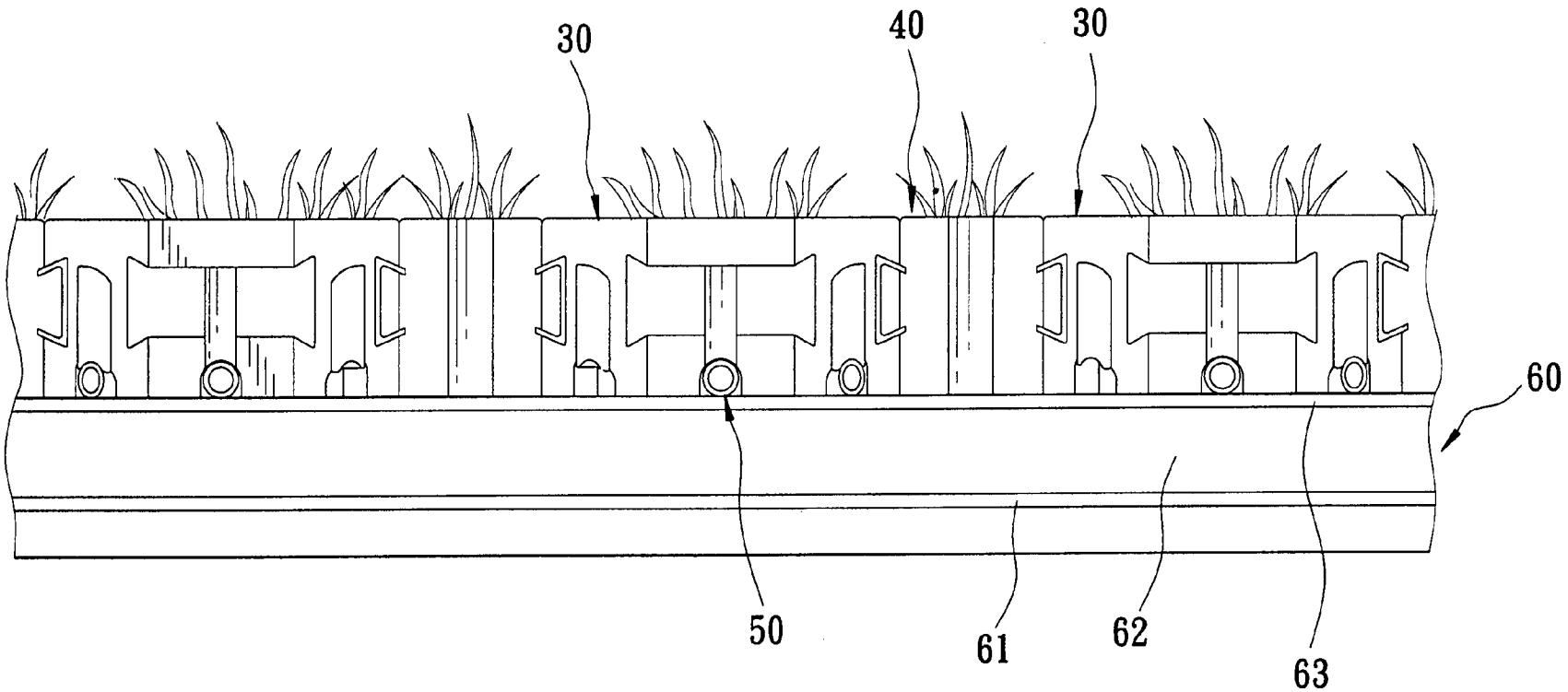
FIG. 3 is a schematic view of the first preferred embodiment of a paving brick assembly according to the present invention.

Before the present invention is described in greater detail with reference to the accompanying preferred embodiments, it should be noted herein that like elements are denoted by the same reference numerals throughout the disclosure.

Figure 6:
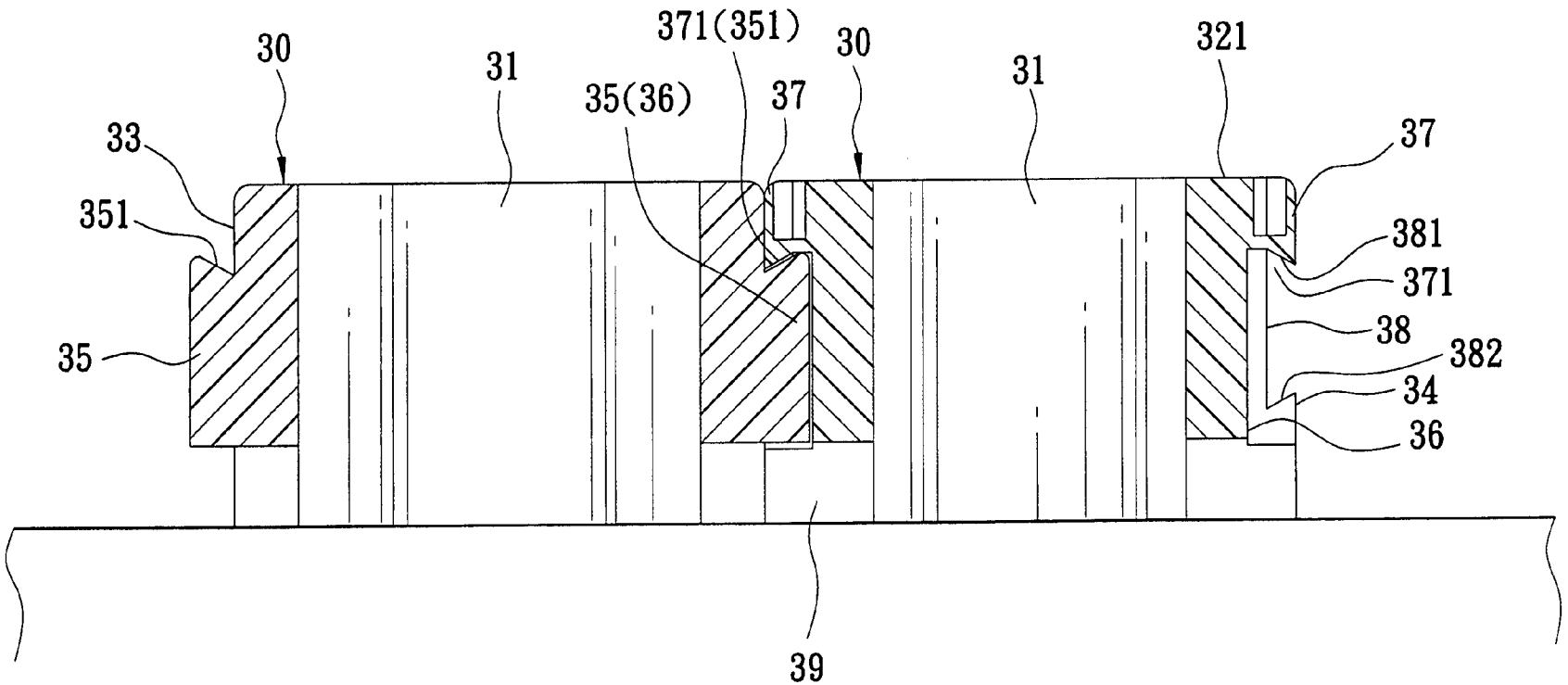
FIG. 6 is a sectional view taken along line VI-VI of FIG. 5.
Figure 7:
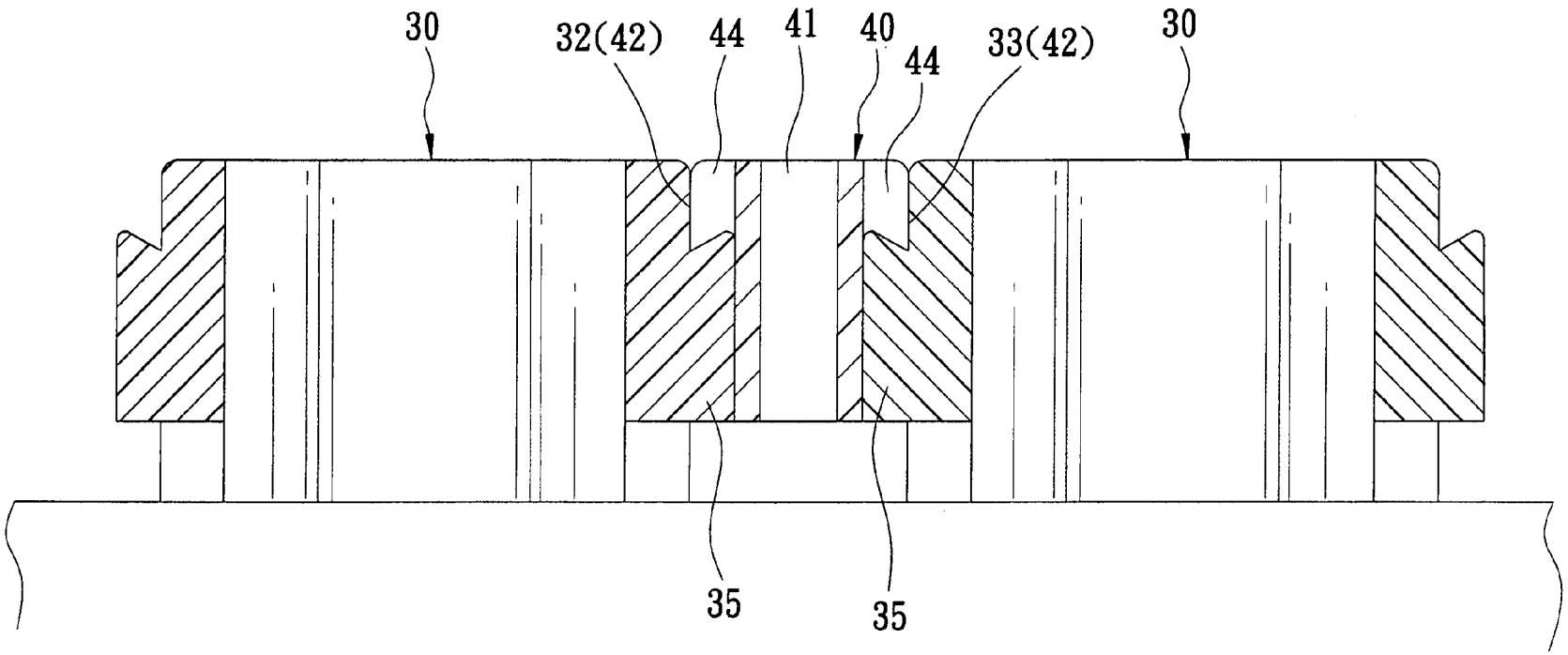
FIG. 7 is a sectional view taken along line VII-VII of FIG. 5.
Figure 8:
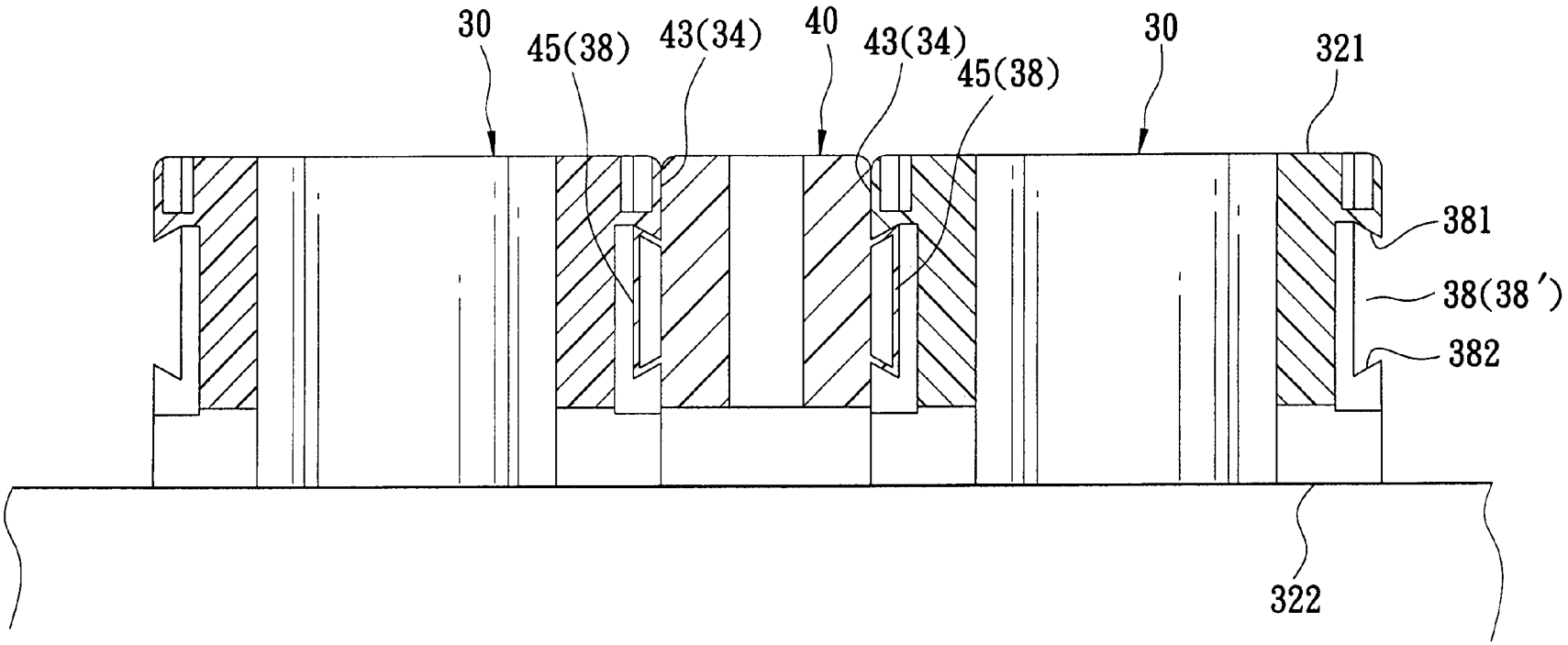
FIG. 8 is a sectional view taken along line VIII-VIII of FIG. 5.

Referring to FIGS. 3 to 5 and 13, the first preferred embodiment of a paving brick assembly according to the present invention is shown to include: a plurality of polygonal main bricks 30, each of which has a plurality of first lateral sides 33 and a plurality of second lateral sides 34 that are alternately disposed with the first lateral sides 33, each of the first lateral sides 33 being formed with a vertical protrusion 35 extending in a vertical direction, each of the second lateral sides 34 being formed with a vertical groove 36 and a horizontal groove 38 extending in a horizontal direction transverse to the vertical direction; and a plurality of polygonal connecting bricks 40, each of which has a pair of opposite connecting lateral sides 43 and a pair of opposite coupling lateral sides 42. Each of the connecting lateral sides 43 is formed with a connecting protrusion 45. Each of the coupling lateral sides 42 is formed with a coupling groove 44. The connecting protrusion 45 of each of the connecting lateral sides 43 of each of the connecting bricks 40 is engageable releasably with the horizontal groove 38 (see FIG. 8) in a selected one of the second lateral sides 34 of a selected one of the main bricks 30 such that the connecting brick 40 thus engaged is removable from the selected one of the main bricks 30 only in the horizontal direction. The coupling groove 44 in each of the coupling lateral sides 42 of each of the connecting bricks 40 is engageable releasably with the vertical protrusion 35 (see FIG. 7) of a selected one of the first lateral sides 33 of a selected one of the main bricks 30. The vertical protrusion 35 of each of the first lateral sides 33 of each of the main bricks 30 is engageable releasably with the vertical groove 36 (see FIG. 6) in a selected one of the second lateral sides 34 of a selected one of the remainder of the main bricks 30 such that the main brick 30 thus engaged is removable from the selected one of the main bricks 30 only in the vertical direction.

In this embodiment, each of the main bricks 30 is further formed with a central hole 31 for receiving soil therein, a plurality of drain holes for drainage of water, and a plurality of pipe retaining grooves 39 for extension of pipes 50 therethrough, respectively. The pipes 50 are used to guide water to flow therethrough. Each of the connecting bricks 40 is formed with a central hole 41 for receiving soil therein. Each of the main bricks 30 is octagonal in shape, and each of the connecting bricks 40 is square in shape. A base layer 60 includes a top protective carpet 63 disposed immediately underneath the paving brick assembly, a filter material 62 disposed under the top protective carpet 63, and a bottom protective carpet 61 disposed under the filter material 62.

The connecting protrusion 45 of each of the connecting lateral sides 43 of each of the connecting bricks 40 has a dovetail-shaped cross-section, and engages snugly the horizontal groove 38 in the selected one of the second lateral sides 34 of the selected one of the main bricks 30.

Each of the main bricks 30 has upper and lower end faces 321, 322. The horizontal groove 38 is defined by a horizontal groove-defining wall 38' that is disposed between and that is spaced apart from the upper and lower end faces 321, 322 and that has upper and lower wall surfaces 381, 382 facing toward each other. The vertical groove 36 in each of the second lateral sides 34 of each of the main bricks 30 extends through the lower wall surface 382 of the horizontal groove-defining wall 38' and through the lower end face 322 of the respective one of the main bricks 30, and is terminated at the upper wall surface 381 of the horizontal groove-defining wall 38'.

Each of the connecting bricks 40 has upper and lower end faces 461, 462. The coupling groove 44 in each of the coupling lateral sides 42 of each of the connecting bricks 40 extends through the upper end face 461 and the lower end face 462 of the respective one of the connecting bricks 40.

The horizontal groove-defining wall 38' of each of the second lateral sides 34 of each of the main bricks 30 is dovetail-shaped, and has an upper portion 37 defining an upper wedging space 371 of the horizontal groove 38. The vertical protrusion 35 of each of the first lateral sides 33 of each of the main bricks 30 has an upper portion 351 wedging into the upper wedging space 371 of the horizontal groove 38 (see FIG. 6) in the selected one of the second lateral sides 34 of the selected one of the remainder of the main bricks 30.

Figure 4:
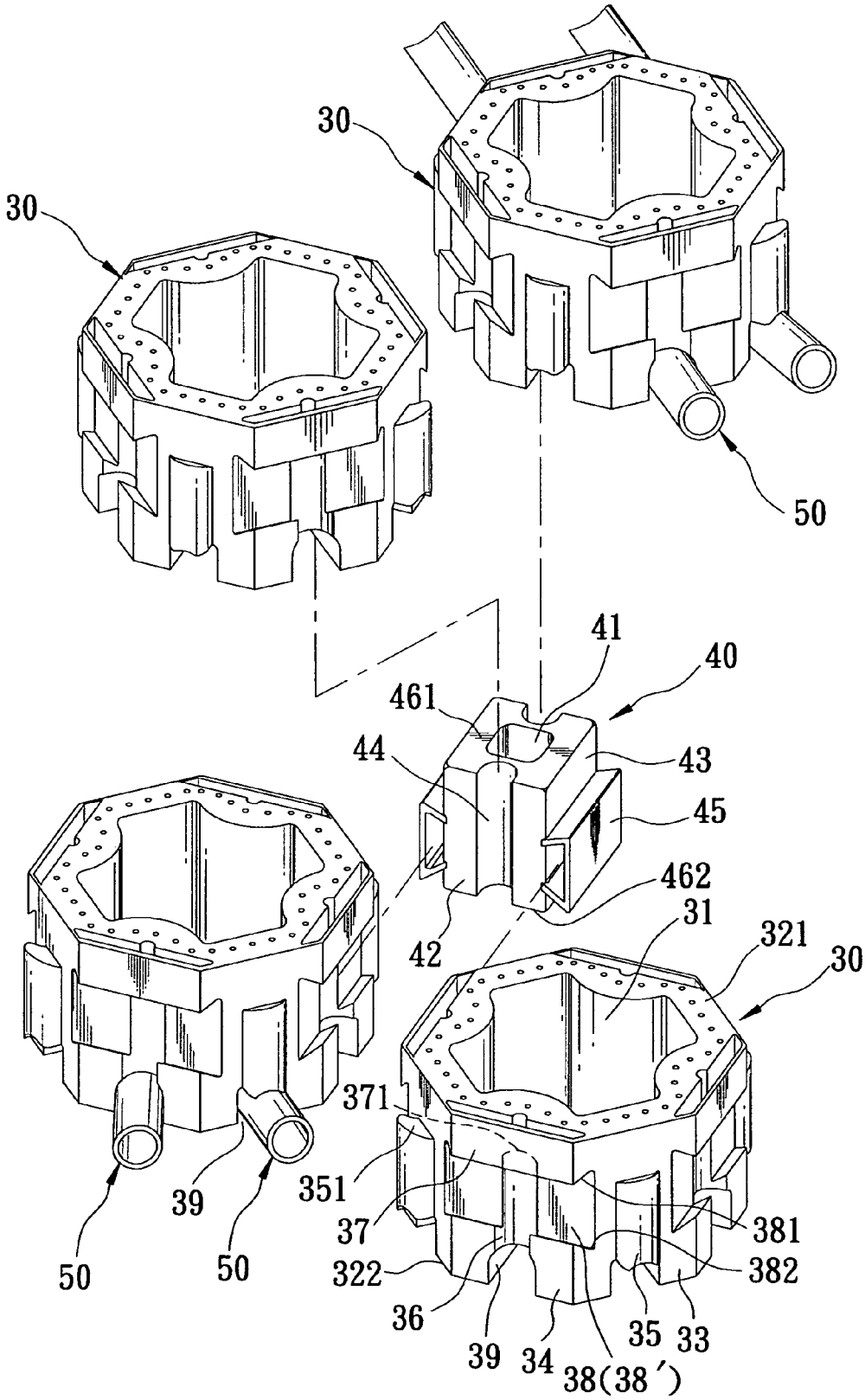
FIG. 4 is a fragmentary exploded perspective view of a paving brick unit of the first preferred embodiment.
Figure 5:
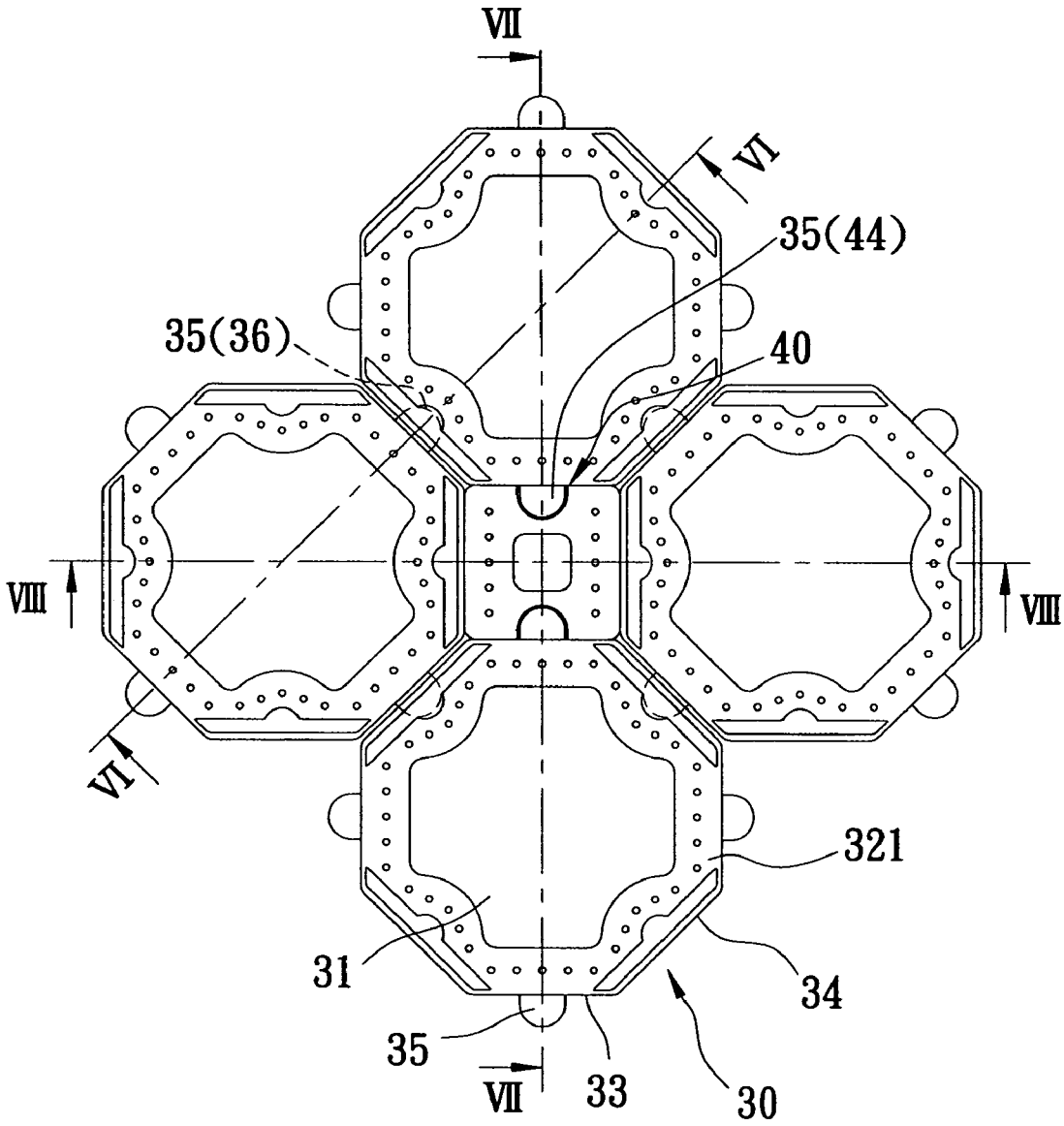
FIG. 5 is a top view of the paving brick unit of the first preferred embodiment.
Figure 9:
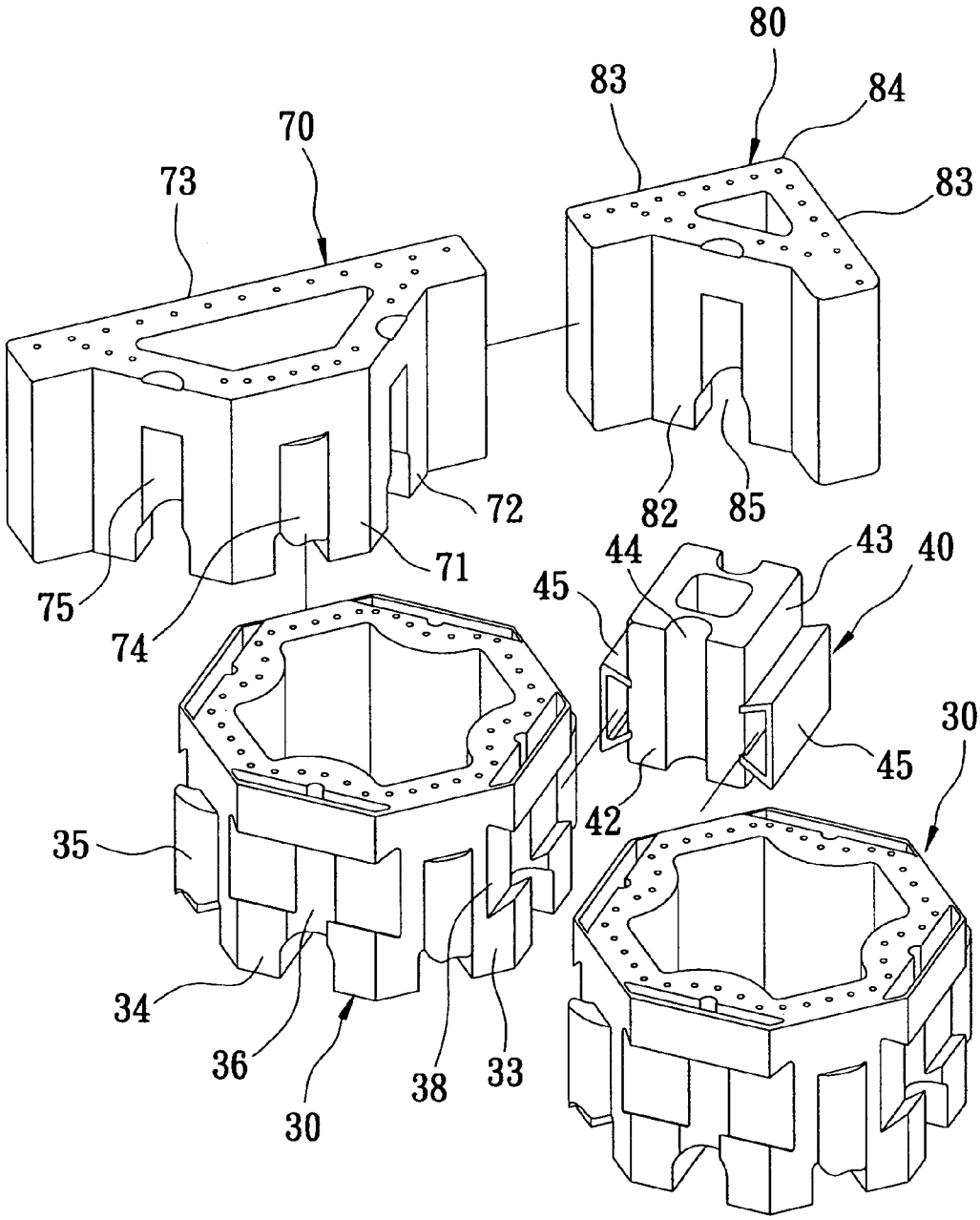
FIG. 9 is an exploded perspective view of another paving brick unit of the first preferred embodiment.
Figure 10:
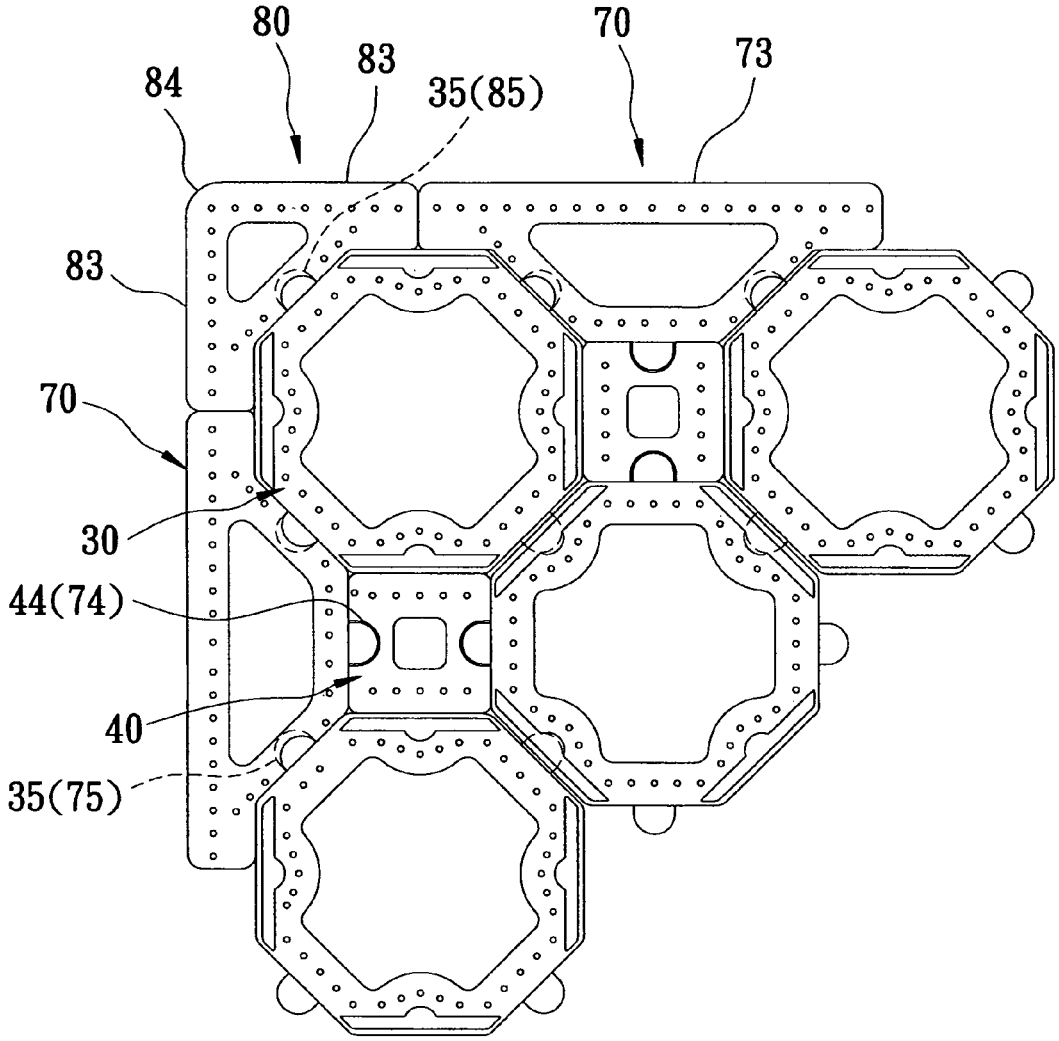
FIG. 10 is a top view of the paving brick unit of FIG. 9.

Referring to FIGS. 9 and 10, in combination with FIG. 4, the paving brick assembly further includes a plurality of side bricks 70 and a plurality of corner bricks 80. Each of the side bricks 70 has an outer side 73, an inner side 71 parallel to the outer side 73, and two opposite inclined sides 72 interconnecting and inclined relative to the inner and outer sides 71, 73. The inner side 71 is formed with an engaging protrusion 74 that is engageable with the coupling groove 44 of a selected one of the coupling lateral sides 42 of a selected one of the connecting bricks 40. Each of the inclined sides 72 is formed with a vertical groove 75 that is engageable with the vertical protrusion 35 of a selected one of the first lateral sides 33 of a selected one of the main bricks 30. Each of the corner bricks 80 has an L-shaped side 84 and an inner side 82 that interconnects two end sections 83 of the L-shaped side 84 and that is formed with a vertical groove 85 engageable with the vertical protrusion 35 of a selected one of the first lateral sides 33 of a selected one of the main bricks 30.

Figure 11:
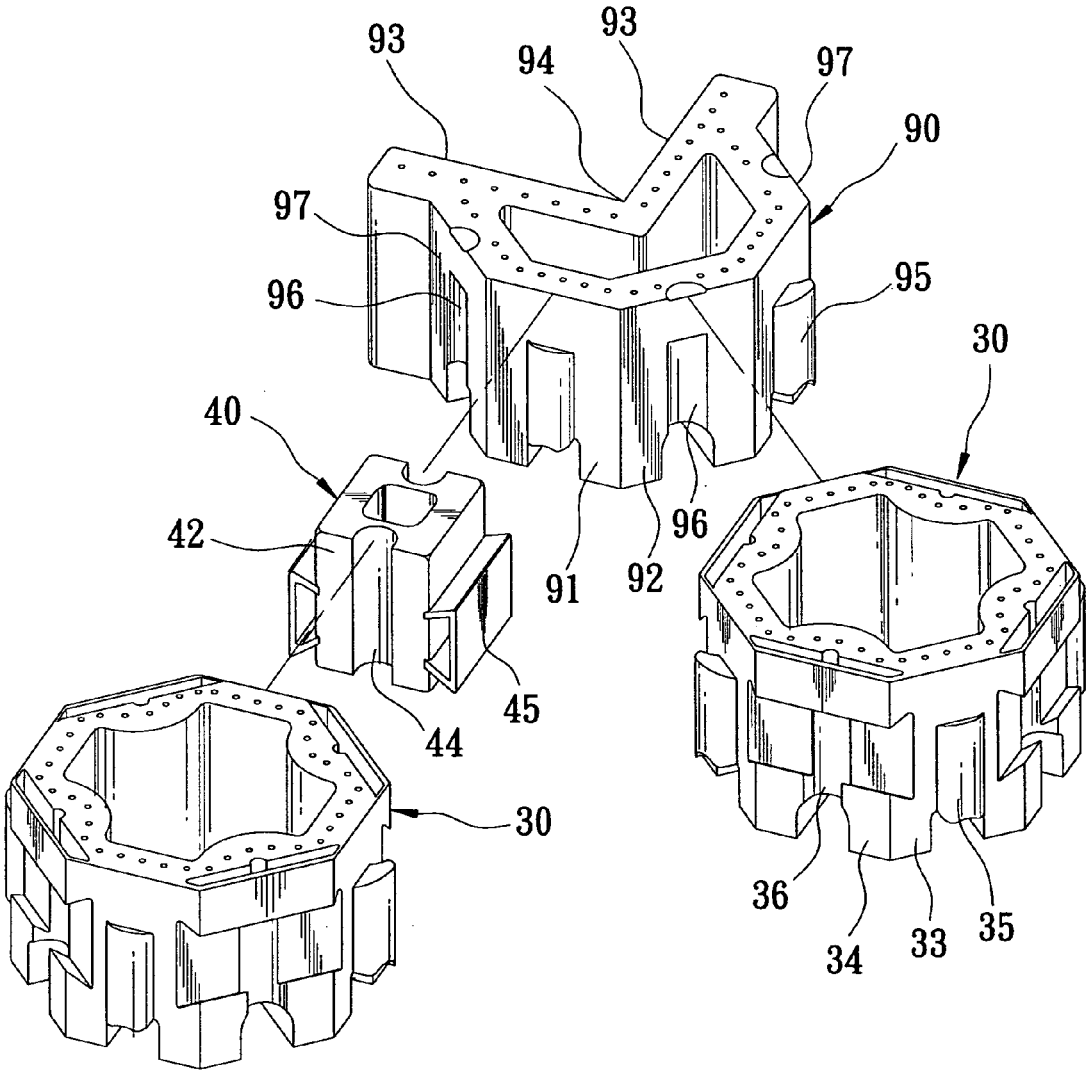
FIG. 11 is an exploded perspective view of a paving brick unit of the second preferred embodiment of a paving brick assembly according to the present invention.
Figure 12:
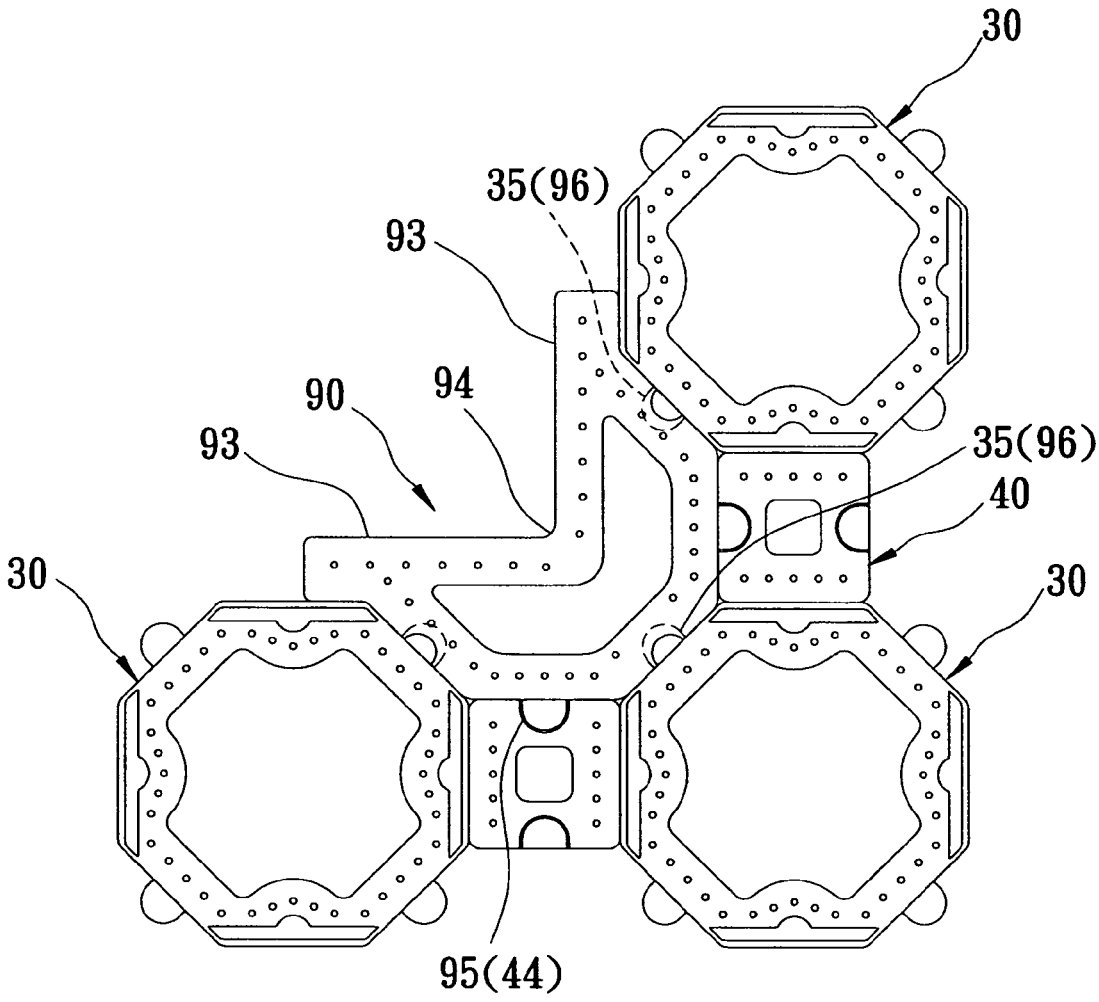
FIG. 12 is a top view of the paving brick unit of FIG. 11.
Figure 13:
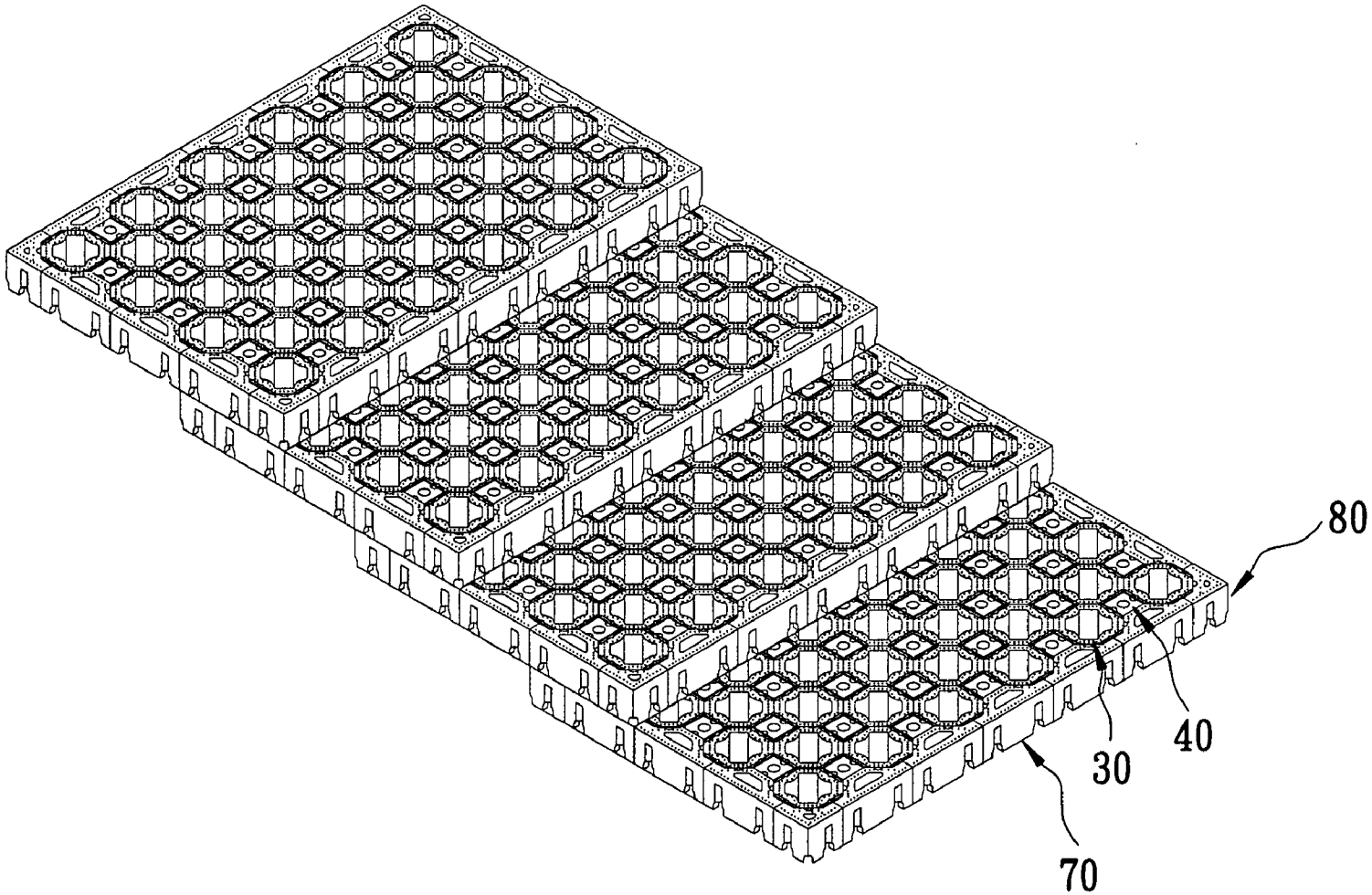
FIG. 13 is a perspective view to illustrate how the first preferred embodiment can be constructed into a stepped structure.

FIGS. 11 and 12 illustrate the second preferred embodiment of the present invention which is shown to further include a plurality of linking bricks 90, each of which has an L-shaped side 94 having two sections 93 transverse to each other, two opposite first sides 97 extending respectively from and inclined relative to the sections 93 of the L-shaped side 94, two opposite second sides 91 extending respectively from the first sides 97 and respectively parallel to the sections 93 of the L-shaped side 94, and an inner side 92 interconnecting the second sides 91. Each of the inner side 92 and the first sides 97 is formed with a vertical groove 96 engageable with the vertical protrusion 35 of a selected one of the first lateral sides 33 of a selected one of the main bricks 30. Each of the second sides 91 is formed with a vertical protrusion 95 engageable with the coupling groove 44 of a selected one of the coupling lateral sides 42 of a selected one of the connecting bricks 40. The inclusion of the linking bricks 90 permits application of the paving brick assembly to a ground area with objects, such as columns.

Figure 14:
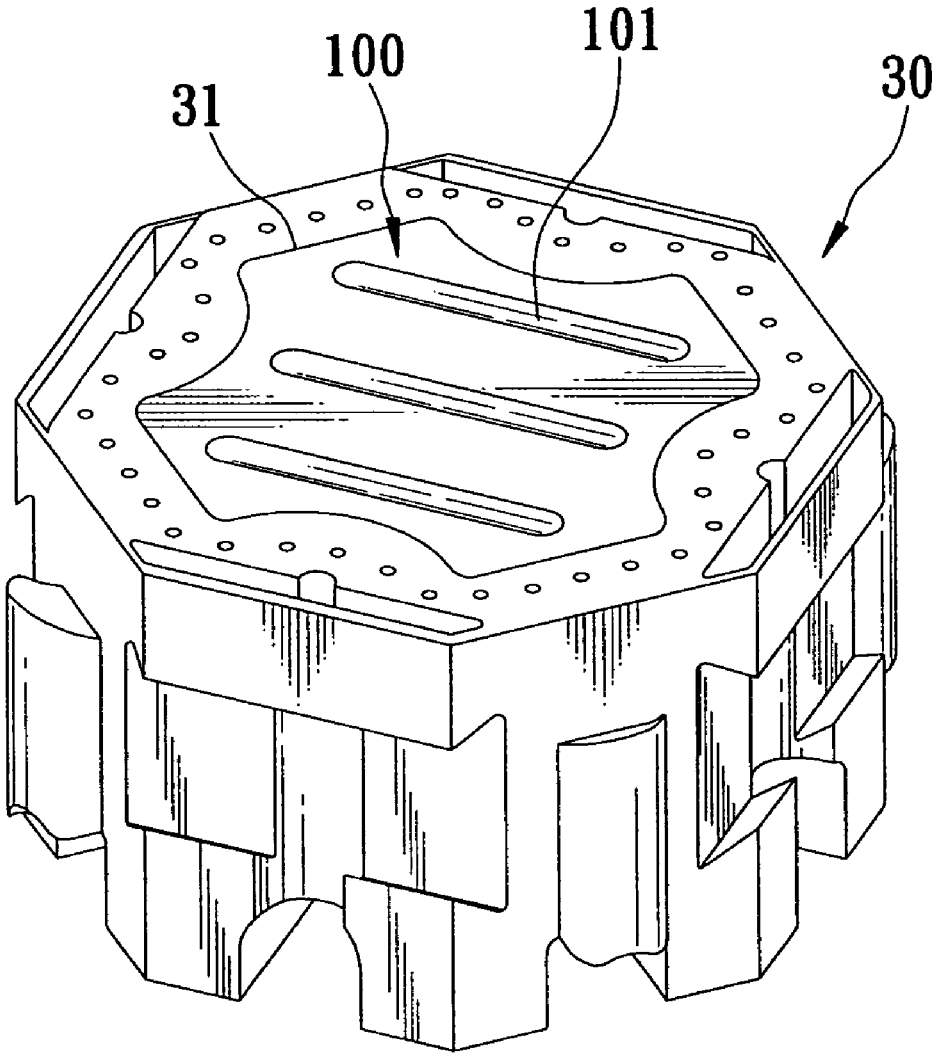
FIG. 14 is a perspective view of a paving brick of the third preferred embodiment of a paving brick assembly according to the present invention.
Figure 15:
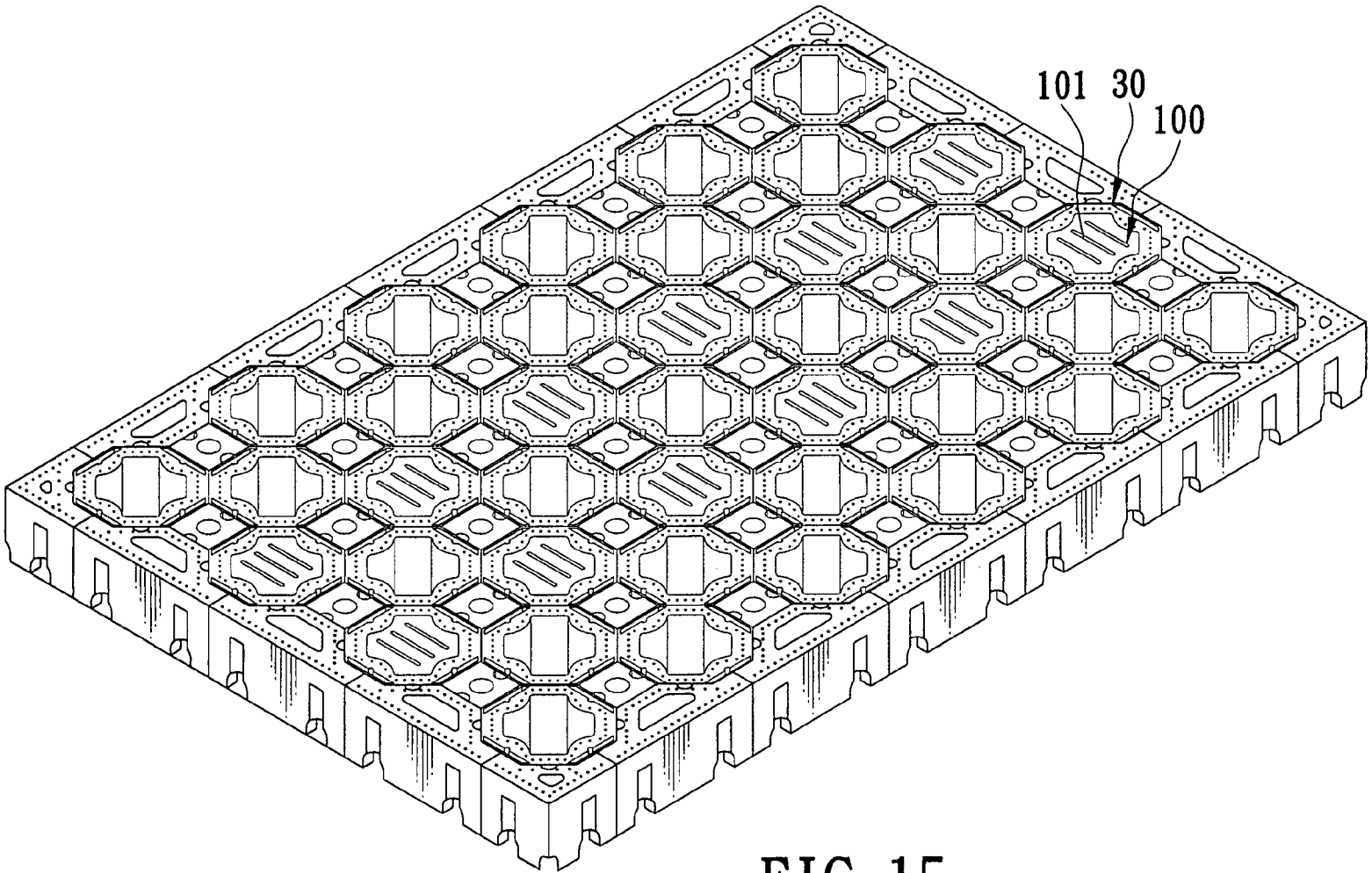
FIG. 15 is an assembled perspective view of the third preferred embodiment.

FIGS. 14 and 15 illustrate the third preferred embodiment of the present invention, which is shown to further include a plurality of guiding bricks 100, each of which is mounted in the central hole 31 in a selected one of the main bricks 30 and each of which has an upper end face formed with a plurality of parallel linear protrusions 101 protruding therefrom. The guiding bricks 100 have the function of guiding the blind.

Figure 16:
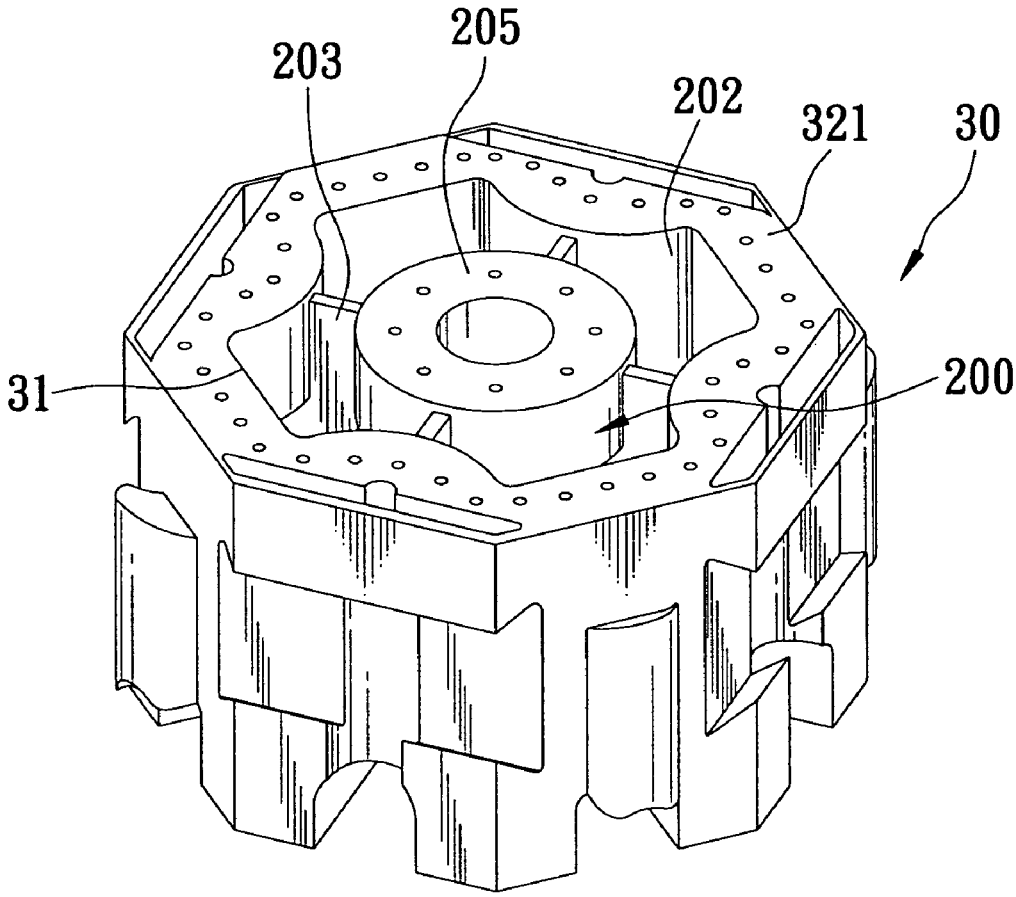
FIG. 16 is a perspective view of a paving brick of the fourth preferred embodiment of a paving brick assembly according to the present invention.
Figure 17:
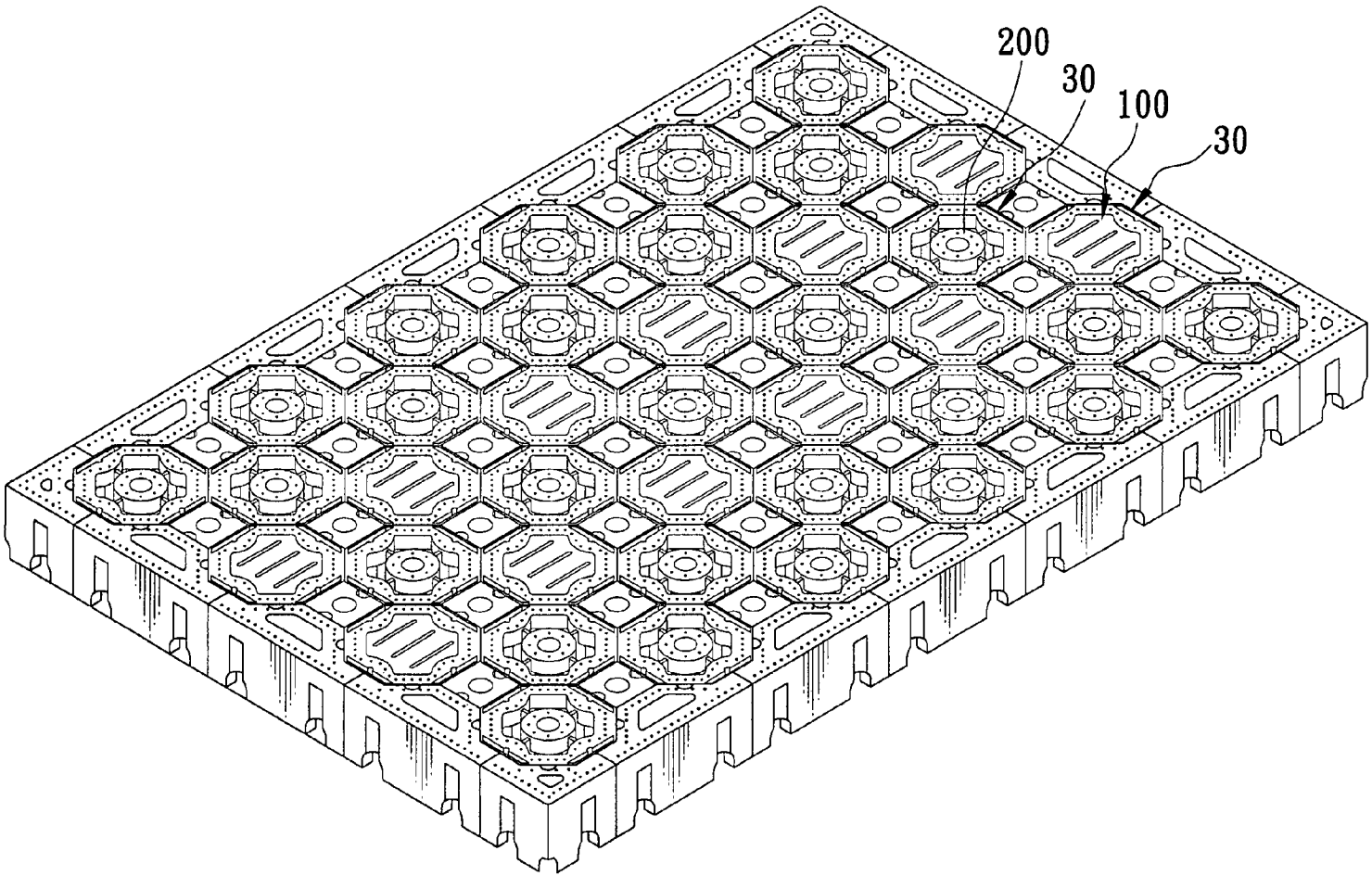
FIG. 17 is an assembled perspective view of the fourth preferred embodiment.

FIGS. 16 and 17 illustrate the fourth preferred embodiment of the present invention which is shown to further include a plurality of annular inner bricks 200, each of which is disposed in the central hole 31 in a selected one of the main bricks 30, cooperates with the selected one of the main bricks 30 to define a gap 202 therebetween, and is formed with a plurality of interconnecting ribs 203 connected to an inner wall of the selected one of the main bricks 30. Each of the annular inner bricks 200 has a top surface 205 flush with the upper end face 321 of the selected main brick 30. The inclusion of the annular inner bricks 200 can increase the foot contact area when stepping thereon.

With the inclusion of the connecting bricks 40 in the paving brick assembly of this invention, the aforesaid drawbacks associated with the prior art can be eliminated.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A paving brick assembly comprising:

a plurality of polygonal main bricks, each of which has a plurality of first lateral sides and a plurality of second lateral sides that are alternately disposed with said first lateral sides, each of said first lateral sides being formed with a vertical protrusion extending in a vertical direction, each of said second lateral sides being formed with a vertical groove and a horizontal groove extending in a horizontal direction transverse to the vertical direction; and a plurality of polygonal connecting bricks, each of which has a pair of opposite connecting lateral sides and a pair of opposite coupling lateral sides, each of said connecting lateral sides being formed with a connecting protrusion, each of said coupling lateral sides being formed with a coupling groove;

wherein said connecting protrusion of each of said connecting lateral sides of each of said connecting bricks is engageable releasably with said horizontal groove in a selected one of said second lateral sides of a selected one of said main bricks;

wherein said coupling groove in each of said coupling lateral sides of each of said connecting bricks is engageable releasably with said vertical protrusion of a selected one of said first lateral sides of a selected one of said main bricks; and wherein said vertical protrusion of each of said first lateral sides of each of said main bricks is engageable releasably with said vertical groove in a selected one of said second lateral sides of a selected one of the remainder of said main bricks.

2. The paving brick assembly as claimed in claim 1, wherein said connecting protrusion of each of said connecting lateral sides of each of said connecting bricks has a dovetail-shaped cross-section, and engages snugly said horizontal groove in the selected one of said second lateral sides of the selected one of said main bricks.

3. The paving brick assembly as claimed in claim 1, wherein each of said main bricks has upper and lower end faces, said horizontal groove being defined by a horizontal groove-defining wall that is disposed between and that is spaced apart from said upper and lower end faces and that has upper and lower wall surfaces facing toward each other, said vertical groove in each of said second lateral sides of each of said main bricks extending through said lower wall surface of said horizontal groove-defining wall and through said lower end face of the respective one of said main bricks and being terminated at said upper wall surface of said horizontal groove-defining wall.

4. The paving brick assembly as claimed in claim 3, wherein each of said connecting bricks has upper and lower end faces, said coupling groove in each of said coupling lateral sides of each of said connecting bricks extending through said upper end face and said lower end face of the respective one of said connecting bricks.

5. The paving brick assembly as claimed in claim 3, wherein said horizontal groove-defining wall of each of said second lateral sides of each of said main bricks is dovetail-shaped and has an upper portion defining an upper wedging space of said horizontal groove, said vertical protrusion of each of said first lateral sides of each of said main bricks having an upper portion wedging into said upper wedging space of said horizontal groove in the selected one of said second lateral sides of the selected one of the remainder of said main bricks.

6. The paving brick assembly as claimed in claim 1, wherein each of said main bricks has a bottom that is formed with at least one retaining groove.

7. The paving brick assembly as claimed in claim 1, wherein each of said main bricks is octagonal in shape, and each of said connecting bricks is square in shape.

8. The paving brick assembly as claimed in claim 7, further comprising a plurality of side bricks, each of which has an outer side, an inner side parallel to said outer side, and two opposite inclined sides interconnecting and inclined relative to said inner and outer sides, said inner side being formed with an engaging protrusion that is engageable with said coupling groove of a selected one of said coupling lateral sides of a selected one of said connecting bricks, each of said inclined sides being formed with a vertical groove that is engageable with said vertical protrusion of a selected one of said first lateral sides of a selected one of said main bricks.

9. The paving brick assembly as claimed in claim 7, further comprising a plurality of corner bricks, each of which has an L-shaped side with two end sections, and an inner side that interconnects said end sections of said L-shaped side and that is formed with a vertical groove engageable with said vertical protrusion of a selected one of said first lateral sides of a selected one of said main bricks.

10. The paving brick assembly as claimed in claim 7, further comprising a plurality of linking bricks, each of which has an L-shaped side having two sections transverse to each other, two opposite first sides extending respectively from and inclined relative to said sections of said L-shaped side, two opposite second sides extending respectively from said first sides and respectively parallel to said sections of said L-shaped side, and an inner side interconnecting said second sides, each of said inner side and said first sides being formed with a vertical groove engageable with said vertical protrusion of a selected one of said first lateral sides of a selected one of said main bricks, each of said second sides being formed with a vertical protrusion engageable with said coupling groove of a selected one of said coupling lateral sides of a selected one of said connecting bricks.

11. The paving brick assembly as claimed in claim 1, further comprising a guiding brick, each of said main bricks being formed with a central hole, said guiding brick being mounted in said central hole in a selected one of said main bricks and having an upper end face formed with a plurality of parallel linear protrusions protruding therefrom.

12. The paving brick assembly as claimed in claim 1, further comprising an annular inner brick, each of said main bricks being formed with a central hole, said annular inner brick being disposed in said central hole in a selected one of said main bricks, cooperating with the selected one of said main bricks to define a gap therebetween, and being formed with a plurality of interconnecting ribs connected to the selected one of said main bricks.

* * * * *